US007735549B1

(12) United States Patent
Nish et al.

(10) Patent No.: US 7,735,549 B1
(45) Date of Patent: Jun. 15, 2010

(54) DRILLABLE DOWN HOLE TOOL

(75) Inventors: Randy W. Nish, Provo, UT (US); Randy A. Jones, Park City, UT (US); Robin Lawson, Salt Lake City, UT (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 322 days.

(21) Appl. No.: 11/800,448

(22) Filed: May 3, 2007

(51) Int. Cl.
*E21B 23/00* (2006.01)
*E21B 33/12* (2006.01)

(52) U.S. Cl. ..... 166/134; 166/179; 166/386

(58) Field of Classification Search ..... 166/179, 166/133, 134, 386, 387, 118
See application file for complete search history.

(56) References Cited

U.S. PATENT DOCUMENTS

| | | | |
|---|---|---|---|
| 4,397,351 | A | 8/1983 | Harris |
| 4,708,202 | A | 11/1987 | Sukup et al. |
| 4,745,972 | A | 5/1988 | Bell et al. |
| 4,784,226 | A | 11/1988 | Wyatt |
| 4,834,184 | A | 5/1989 | Streich et al. |
| 5,086,839 | A | 2/1992 | Setterberg, Jr. et al. |
| 5,131,468 | A | 7/1992 | Lane et al. |
| 5,224,540 | A | 7/1993 | Streich et al. |
| 5,271,468 | A | 12/1993 | Streich et al. |
| 5,390,737 | A | 2/1995 | Jacobi et al. |
| 5,540,279 | A | 7/1996 | Branch et al. |
| 5,819,846 | A | 10/1998 | Bolt, Jr. |
| 5,839,515 | A | 11/1998 | Yuan et al. |
| 5,984,007 | A | 11/1999 | Yuan et al. |
| 6,167,963 | B1 | 1/2001 | McMahan et al. |
| 6,220,349 | B1 | 4/2001 | Vargus et al. |
| 6,244,642 | B1 | 6/2001 | Serafin et al. |
| 6,318,461 | B1 | 11/2001 | Carisella |
| 6,354,372 | B1 | 3/2002 | Carisella et al. |
| 6,491,108 | B1 | 12/2002 | Slup et al. |
| 6,578,633 | B2 | 6/2003 | Slup et al. |
| 6,581,681 | B1 | 6/2003 | Zimmerman et al. |

(Continued)

OTHER PUBLICATIONS

Baker Hughes Baker Oil Tools Remedial Systems Technical Unit QUIK Drill Composite Bridge Plug and Wireline Adapter Kit Product Family Nos. H40129 and H43848, Feb. 28, 2002, pp. 1-12.

(Continued)

*Primary Examiner*—Jennifer H Gay
*Assistant Examiner*—Yong-Suk Ro
(74) *Attorney, Agent, or Firm*—Davidson Berquist Jackson & Gowdey LLP

(57) ABSTRACT

A down hole flow control device used in a well bore includes a central mandrel and a packer ring disposed thereon. The packer ring is compressible along a longitudinal axis of the central mandrel to form a seal between the central mandrel and the well bore. Upper and lower slip rings are disposed on the central mandrel and include a plurality of slip segments joined together by fracture regions to form the slip rings. The fracture regions are configured to facilitate longitudinal fractures to break the slip rings into the plurality of slip segments that secure the down hole flow control device in the well bore. The upper and lower slip rings have different fracture regions from one another to induce sequential fracturing with respect to the upper and lower slip rings when an axial load is applied to both the upper slip ring and the lower slip ring.

17 Claims, 13 Drawing Sheets

U.S. PATENT DOCUMENTS

| | | | |
|---|---|---|---|
| 6,598,672 | B2 | 7/2003 | Bell et al. |
| 6,695,050 | B2 | 2/2004 | Winslow et al. |
| 6,695,051 | B2 | 2/2004 | Smith et al. |
| 6,708,768 | B2 | 3/2004 | Slup et al. |
| 6,708,770 | B2 | 3/2004 | Slup et al. |
| 6,712,153 | B2 | 3/2004 | Turley et al. |
| 6,793,022 | B2 | 9/2004 | Vick et al. |
| 6,796,376 | B2 | 9/2004 | Frazier |
| 6,827,150 | B2 | 12/2004 | Luke |
| 6,976,534 | B2 | 12/2005 | Sutton et al. |
| 6,986,390 | B2 | 1/2006 | Doane et al. |
| 7,017,672 | B2 | 3/2006 | Owen, Sr. |
| 7,036,602 | B2 | 5/2006 | Turley et al. |
| 7,210,533 | B2 | 5/2007 | Starr et a |
| 2002/0070503 | A1 | 6/2002 | Zimmerman et al. |
| 2004/0036225 | A1 | 2/2004 | Ritter et al. |
| 2004/0045723 | A1 | 3/2004 | Slup et al. |
| 2004/0177952 | A1 | 9/2004 | Turley et al. |
| 2005/0189103 | A1 | 9/2005 | Roberts et al. |
| 2007/0074873 | A1 | 4/2007 | McKeachnie et al. |
| 2007/0102165 | A1 | 5/2007 | Slup et al. |
| 2007/0119600 | A1 * | 5/2007 | Slup et al. ..... 166/387 |
| 2008/0060821 | A1 * | 3/2008 | Smith et al. ..... 166/387 |

OTHER PUBLICATIONS

Weatherford FracGuard Composite Plugs, 2004, 7 pages.
BJ Python Composite Bridge Plug, Product Information Sep. 20, 2001, 1 page.
Halliburton FAS Drill Squeeze Packers, Drillable Tools, 1999, 6 pages.
Weatherford Completion Systems FracGuard Series Composite Frac Plug 2001, Brochure No. 432.00 & 433.00; 2 pages.

* cited by examiner

DRILLABLE DOWN HOLE TOOL

BACKGROUND OF THE INVENTION

1. Field of the Invention

This invention relates generally to down hole tools for use in oil and gas wells, and more particularly to down hole tools having drillable materials and metallic slips.

2. Related Art

Down hole tools, such as well packers, bridge plugs, fracture ("frac") plugs, cement retainers, and the like, are commonly used in oil or gas wells for fluid control in both completion and production efficiency applications. For example, such down hole tools are often placed in the bore of a well to form a seal between the well tubing and casing in order to isolate one or more vertical portions of the well. A tool can also be placed inside the casing to isolate one elevation from another during formation fracturing and treatment operations.

Down hole tools often have central mandrel with lower slip elements adjacent a lower slip wedge and upper slip elements adjacent an upper slip wedge. The slip elements are often made of a cast iron material, composite material or the like, so as to facilitate drill out when removal of the down hole tool is desired. Additionally, a compressible packer is disposed between the upper and lower slip elements. The compressible packer is often made of an elastomeric material such as rubber so that the compressible packer can conform to the shape of the surrounding well bore and down hole tool in order to form a seal between the well bore wall or casing and the central mandrel.

In use, the down hole tool is positioned in the well bore at a desired depth and an axial force is applied to the upper and lower slip segments such that the upper and lower slip segments are moved closer together along the longitudinal axis of the central mandrel so as to compress the compressible packer. As the compressible packer is compressed, the packer bulges radially outward to form a seal between the central mandrel and the well bore wall or casing. Additionally, the upper and lower wedges are forced under the upper and lower slip elements, respectively, to force the slip elements radially outward away from the mandrel toward the well bore wall or casing in order to set the tool in the well bore by engaging the well bore wall or casing.

Because down hole tools are used in a wide range of well bore environments, they must be able to withstand extremes of high temperature and pressure as well as corrosive fluids, such as acid or brine solutions, superheated water, steam, and other natural formation fluids, as well as fluids used in oil or gas well operations. During normal well completion operations, the down hole tools must be removed to allow the installation of tubing to the bottom of the well to begin the recovery of oil and gas. In order to facilitate removal of these tools, the components are usually made of easily drillable materials, such as cast iron, fibrous composite materials, and the like.

Unfortunately, the down hole tools described above have some problems For example, the slip elements are often made of a cast iron ring with stress risers spaced about the ring. The stress risers are configured to fracture the ring into separable slip elements when the slip wedges apply radial forces on the cast iron ring. Unfortunately, the rings sometimes do not fracture along the stress risers, or the stress risers do not fracture uniformly so that the separable slip elements are not evenly formed. When this happens one of the separable slip elements may be larger than another so that when the slip elements engage the well bore wall or casing an uneven loading is applied around the central mandrel. This uneven loading can result in movement of the down hole tool over time as it is used in the well bore and which results in an loss of seal or damage to other well components.

Another problem of the down hole tools described above is that the cast iron rings that separate into the slip segments often fracture into the separable segments at nearly the same time. This can result in setting of the tool in the well bore before the compressible packer is sufficiently compressed to form an optimal seal between the central mandrel and the well bore wall or case.

Still another problem of the down hole tools described above is that the compressible packer is often exposed to a wide range of temperatures. Sometimes the temperatures can soften or melt the polymer of the compressible packer such that the packer material can flow under pressure around the slip wedge and through the gaps between the separated slip elements such that the integrity of the seal can be compromised. Alternately, the packer material can flow into the gap between the conical wedge outer diameter and the casing inside diameter.

SUMMARY OF THE INVENTION

It has been recognized that it would be advantageous to develop a device and method for setting a down hole tool in a well bore using slip rings having fracture regions that separate the slip ring into substantially equally sized slip elements. In addition, it has been recognized that it would be advantageous to develop a device and method for setting a down hole tool in a well bore using upper and lower slip rings having fracture regions that sequentially separate the lower slip ring into slip elements before separating the upper slip ring into slip elements. In addition, it has been recognized that it would be advantageous to develop a device and method for setting a down hole tool in a well bore using upper and lower backing rings having fracture regions that separate the backing rings into segments that retain a compressible packer and reduce longitudinal extrusion of the packer when the packer is compressed to form a seal between the down hole tool and the well bore.

The present invention provides a remotely deployable, disposable, drillable down hole flow control device for use in a well bore including a central mandrel sized and shaped to fit within a well bore and a packer ring disposed thereon. The packer ring can be compressible along a longitudinal axis of the central mandrel to form a seal between the central mandrel and the well bore. An upper slip ring and a lower slip ring can be disposed on the central mandrel. The upper slip ring can be disposed above the packer ring and the lower slip ring can be disposed below the packer ring. Each of the upper and lower slip rings can include a plurality of slip segments joined together by fracture regions to form the slip ring. The fracture regions can be configured to facilitate longitudinal fractures to break the slip rings into the plurality of slip segments. Each of the plurality of slip segments can be configured to secure the down hole flow control device in the well bore. Additionally, the upper and lower slip rings can have different fracture regions from one another so as to induce sequential fracturing with respect to the upper and lower slip rings when an axial load is applied to both the upper slip ring and the lower slip ring.

In another more detailed aspect of the present, the down hole flow control device can also include an upper cone and a lower cone disposed on the central mandrel adjacent the upper and lower slip rings. Each of the upper and lower cones can be sized and shaped to induce load into the upper or lower slip rings, respectively, so as to cause the slip rings to fracture into slip segments when the axial load is applied to the upper slip ring. Additionally, a plurality of stress inducers can be disposed about the upper and lower cones. Each stress inducer can correspond to a respective fracture region in the upper and lower slip rings. Each stress inducer can also be sized and shaped to transfer an applied load from the upper or lower cone to the fracture region of the upper or lower slip rings to reduce uneven fracturing of the slip rings into slip segments.

In yet another more detailed aspect of the present invention, the down hole flow control device can also include an upper backing ring and a lower backing ring disposed on the central mandrel between the packer ring and the upper and lower slip rings, respectively. Each of the upper and lower backing rings can include a plurality of backing segments disposed circumferentially around the central mandrel, and a plurality of fracture regions disposed between respective backing segments. The fracture regions can be configured to fracture the upper and lower backing rings into the plurality of backing segments when the axial load induces stress in the fracture regions. The backing segments can also be sized and shaped to reduce longitudinal extrusion of the packer ring when the packer ring is compressed to form the seal between the central mandrel and the well bore.

Additional features and advantages of the invention will be apparent from the detailed description which follows, taken in conjunction with the accompanying drawings, which together illustrate, by way of example, features of the invention.

DETAILED DESCRIPTION

Figure 1A:
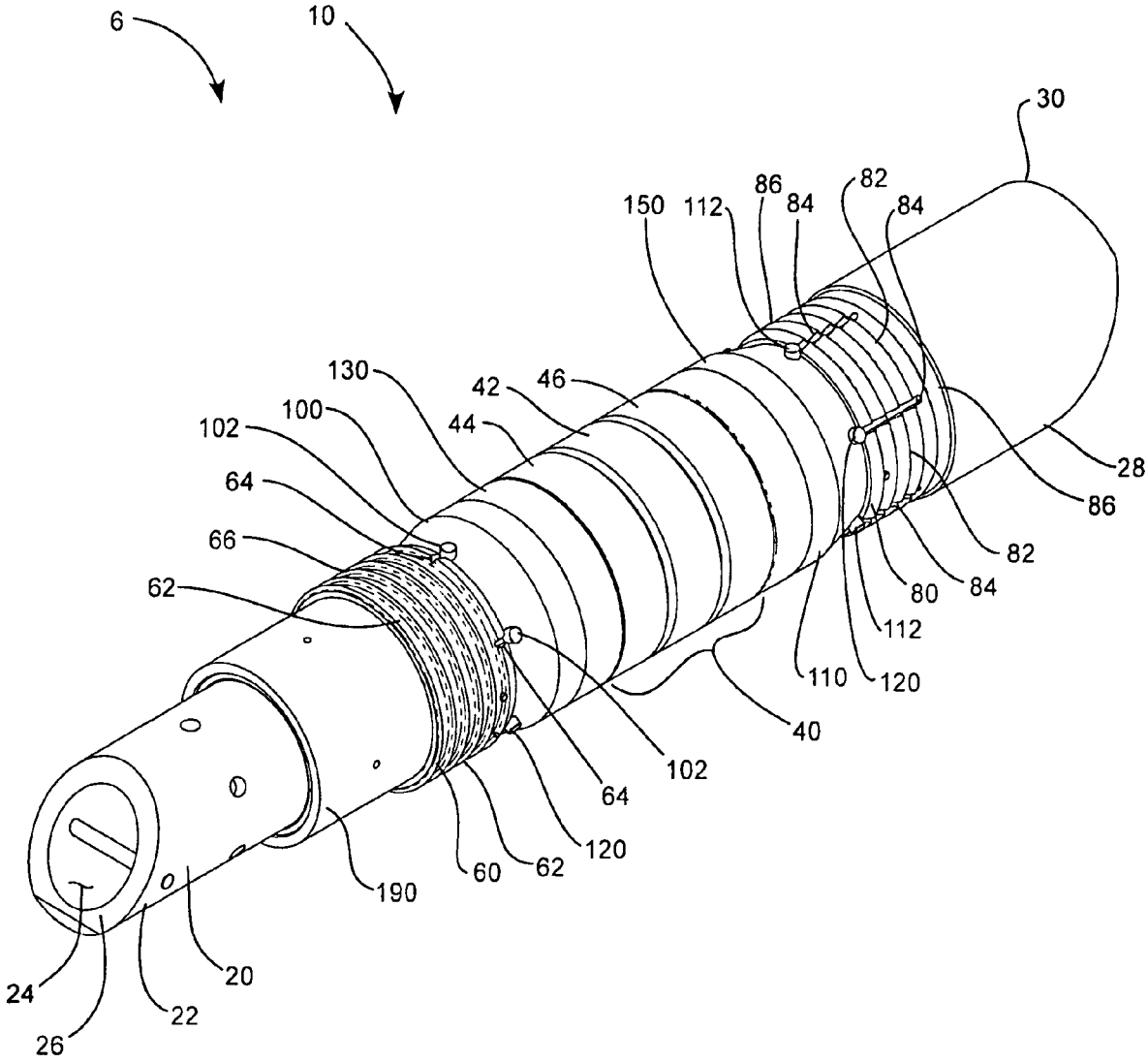
FIG. 1*a* is a perspective view of a down hole flow control device in accordance with an embodiment of the present invention shown in use with a frac plug down hole tool.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1*a*-4, a remotely deployable, disposable, drillable down hole flow control device, indicated generally at 10, in accordance with an embodiment of the present invention is shown for use in a well bore as a down hole tool. The down hole flow control device 10 can be remotely deployable at the surface of a well and can be disposable so as to eliminate the need to retrieve the device. One way the down hole flow control device 10 can be disposed is by drilling or machining the device out of the well bore after deployment. Thus, the down hole flow control device 10 can be used as a down hole tool such as a frac plug, indicated generally at 6 and shown in FIGS. 1*a*-1*b*, a bridge plug, indicated generally at 8 and shown in FIGS. 2*a*-2*b*, a cement retainer (not shown), well packer (not shown), a kill plug (not shown), and the like in a well bore as used in a gas or oil well. The down hole flow control device 10 can include a central mandrel 20, a compressible packer ring 40, an upper slip ring and a lower slip ring.

Referring to FIGS. 1*a*-5, the central mandrel 20 can be sized and shaped to fit within a well bore, tube or casing for an oil or gas well. The central mandrel 20 can have a cylindrical body 22 with a hollow center 24 that can be open on at least a proximal end 26. The body 22 can be sized and shaped to fit within a well bore and have a predetermined clearance distance from the well bore wall or casing. The central mandrel 20 can also have a cylindrical anvil 28 on a distal end 30. The anvil 28 can be sized and shaped to fit within the well bore and substantially fill the cross sectional area of the well bore. In one aspect, the diameter of the anvil 28 can be slightly smaller than the diameter of the well bore or casing such that the anvil is a tight fit within the well bore, yet have enough clearance so as to be able to move along the well bore.

The proximal end 26 and the distal end 30 of the central mandrel 20 can be angled with respect to the longitudinal axis, indicated by a dashed line at 32, of the central mandrel so as to accommodate placement in the well bore adjacent other down hole tools or flow control devices. The angle of the ends 26 and 30 can correspond and match with an angled end of the adjacent down hole tool or flow control device so as to rotationally secure the two devices together, thereby restricting rotation of any one device in the well bore with respect to other devices in the well bore.

The central mandrel 20 can be formed of a material that is easily drilled or machined, such as cast iron, fiber and resin composite, and the like. In the case where the central mandrel 20 is made of a composite material, the fiber can be rotationally wound in plies having predetermined ply angles with respect to one another and the resin can have polymeric properties suitable for extreme environments, as known in the art. In one aspect, the composite article can include a tetrafunctional epoxy resin with an aromatic diamine curative. Additionally, other types of resin devices, such as bismaleimide, phenolic, thermoplastic, and the like can be used. The fibers can be E-type and ECR type glass fibers as well as carbon fibers. It will be appreciated that other types of mineral fibers, such as silica, basalt, and the like, can be used for high temperature applications.

Referring to FIGS. 1*a*-4 and 6, the compressible packer ring 40 can be disposed on the cylindrical body 22 of the central mandrel 20. The packer ring 40 can have an outer diameter just slightly smaller than the diameter of the well bore and can correspond in size with the anvil 28 of the central mandrel. The packer ring 40 can be compressible along the longitudinal axis 32 of the central mandrel 20 and radially expandable in order to form a seal between the central mandrel 20 and the well bore. The packer ring 40 can be formed of an elastomeric polymer that can conform to the shape of the well bore or casing and the central mandrel 20.

In one aspect, the packer ring 40 can be formed of three rings, including a central ring 42 and two outer rings 44 and 46 on either side of the central ring. In this case, each of the three rings 42, 44, and 46 can be formed of an elastomeric material having different physical properties from one another, such as durometer, glass transition temperatures, melting points, and elastic moduluses, from the other rings. In this way, each of the rings forming the packer ring 40 can withstand different environmental conditions, such as temperature or pressure, so as to maintain the seal between the well bore or casing over a wide variety of environmental conditions.

Referring to FIGS. 1*a*-4 and 7-10, the upper slip ring 60 and the lower slip ring 80 can also be disposed on the central mandrel 20 with the upper slip ring 60 disposed above the packer ring 40 and the lower slip ring 80 disposed below the packer ring 40. Each of the upper and lower slip rings 60 and 80 can include a plurality of slip segments 62 and 82, respectively, that can be joined together by fracture regions 64 and 84 respectively, to form the rings 62 and 82. The fracture regions 64 and 84 can facilitate longitudinal fractures to break the slip rings 60 and 80 into the plurality of slip segments 62 and 82. Each of the plurality of slip segments can be configured to be displaceable radially to secure the down hole flow control device 10 in the well bore.

The upper and lower slip rings 60 and 80 can have a plurality of raised ridges 66 and 86, respectively, that extend circumferentially around the outer diameter of each of the rings. The ridges 66 and 86 can be sized and shaped to bite into the well bore wall or casing. Thus, when an outward radial force is exerted on the slip rings 60 and 80, the fracture regions 64 and 84 can break the slip rings into the separable slip segments 62 and 82 that can bite into the well bore or casing wall and wedge between the down hole flow control device and the well bore. In this way, the upper and lower slip segments 62 and 82 can secure or anchor the down hole flow control device 10 in a desired location in the well bore.

The upper and lower slip rings 60 and 80 can be formed of a material that is easily drilled or machined so as to facilitate easy removal of the down hole flow control device from a well bore. For example, the upper and lower slip rings 60 and 80 can be formed of a cast iron or composite material. Additionally, the fracture regions 64 and 84 can be formed by stress concentrators, stress risers, material flaws, notches, slots, variations in material properties, and the like, that can produce a weaker region in the slip ring.

In one aspect, the upper and lower slip rings 60 and 80 can be formed of a composite material including fiber windings, fiber mats, chopped fibers, or the like, and a resin material. In this case, the fracture regions can be formed by a disruption in the fiber matrix, or introduction of gaps in the fiber matrix at predetermined locations around the ring. In this way, the material difference in the composite article can form the fracture region that results in longitudinal fractures of the ring at the locations of the fracture regions.

In another aspect, as shown in FIGS. 7-10, the upper and lower slip rings 60 and 80 can be formed of a material such as cast iron. The cast iron can be machined at desired locations around the ring to produce materially thinner regions 70 and 90 such as notches or longitudinal slots in the ring that will fracture under an applied load. In this way, the thinner regions 70 and 90 in the cast iron ring can form the fracture region that results in longitudinal fractures of the ring at the locations of the fracture regions.

In yet another aspect, the upper and lower slip rings 60 and 80 can also have different fracture regions 64 and 84 from one another. For example, in the case where the slip rings 60 and 80 are formed of a cast iron material and the fracture regions 64 and 84 can include longitudinal slots spaced circumferentially around the ring, the longitudinal slots 90 of the lower slip ring 80 can be larger than the slots 70 of the upper slip ring 60. Thus, the fracture regions 84 of the lower slip ring 80 can include less material than the fracture regions 64 of the upper slip ring 60. In this way, the lower slip ring 80 can be designed to fracture before the upper slip ring 60 so as to induce sequential fracturing with respect to the upper and lower slip rings 60 and 80 when an axial load is applied to both the upper slip ring and the lower slip ring.

This sequential bottom up fracturing mechanism is a particular advantage of the down hole flow control device 10 of the present invention as described herein. It will be appreciated that compression of the packer ring 40 can occur when the distance between the upper and lower slip rings 60 and 80 is decreased such that the upper and lower slip rings 60 and 80 squeeze or compress the packer ring 40 between them. The sequential fracturing mechanism of the down hole flow control device 10 described above advantageously allows the lower slip ring 80 to set first, while the upper slip ring 60 can continue to move longitudinally along the central mandrel 20 until the upper slip ring 60 compresses the packer ring 40 against the lower slip ring 80. In this way, the lower slip ring 80 sets and anchors the tool to the well bore or casing wall and the upper ring 60 can be pushed downward toward the lower ring 80, thereby squeezing or compressing the packer ring 40 that is sandwiched between the upper and lower slip rings 60 and 80.

Referring to FIGS. 1*a*-4 and 11, the down hole flow control device 10 can also include a top stop 190 disposed about the central mandrel 20 adjacent the upper slip ring. The top stop 190 can move along the longitudinal axis of the central mandrel 20 such that the top stop 190 can be pushed downward along the central mandrel to move the upper slip ring 60 toward the lower slip ring 80, thereby inducing the axial load in the upper and lower slip rings and the compressible packer ring 40. In this way, the compressible packer ring 40 can be compressed to form the seal between the well bore all or casing and the central mandrel 20.

Referring to FIGS. 1*a*-4 and 12-13, the down hole flow control device 10 can also include an upper cone 100 and a lower cone 110 that can be disposed on the central mandrel 20 adjacent the upper and lower slip rings 60 and 80. Each of the upper and lower cones 100 and 110 can be sized and shaped to fit under the upper and lower slip rings 60 and 80 so as to induce stress into the upper or lower slip ring 60 and 80, respectively. The upper and lower cones 100 and 110 can induce stress into the upper or lower slip rings 60 and 80 by redirecting the axial load pushing the upper and lower slip rings together against the anvil 28 and the packer ring 40 to a radial load that can push radially outward from under the upper and lower slip rings. This outward radial loading can cause the upper and lower slip rings 60 and 80 to fracture into slip segments 62 and 82 when the axial load is applied and moves the upper slip ring 60 toward the lower slip ring 80.

The upper and lower cones 100 and 110 can be formed from a material that is easily drilled or machined such as cast iron or a composite material. In one aspect the upper and lower cones 100 and 110 can be fabricated from a fiber and resin composite material with fiber windings, fiber mats, or chopped fibers infused with a resin material. Advantageously, the composite material can be easily drilled or machined so as to facilitate removal of the down hole flow control device 10 from a well bore after the slip segments have engaged the well bore wall or casing.

The upper and lower cones 100 and 110 can also include a plurality of stress inducers 102 and 112 disposed about the upper and lower cones. The stress inducers 102 and 112 can be pins 120 that can be set into holes 104 and 114 in the conical faces 106 and 116 of the upper and lower cones 60 and 80, and dispersed around the circumference of the conical faces. The location of the pins 120 around the circumference of the cones can correspond to the location of the fracture regions 64 and 84 (or the slots) of the upper and lower slip rings 60 and 80. In this way, each stress inducer 102 and 112 can be positioned adjacent a corresponding respective fracture region 64 or 84, respectively, in the upper and lower slip rings. Advantageously, the stress inducers 102 and 112 can be sized and shaped to transfer an applied load from the upper or lower cone 100 and 110 to the fracture regions 64 and 84 of the upper or lower slip rings 60 or 80, respectively, in order to cause fracturing of the slip ring at the fracture region and to reduce uneven or unwanted fracturing of the slip rings at locations other than the fracture regions. Additionally, the stress inducers 102 and 112 can help to move the individual slip segments into substantially uniformly spaced circumferential positions around the upper and lower cones 100 and 110, respectively. In this way the stress inducers 102 and 112 can promote fracturing of the upper and lower slip rings 60 and 80 into substantially similarly sized and shaped slip segments 62 and 82.

Referring to FIGS. 1*a*-4 and 14, the down hole flow control device 10 can also have an upper backing ring 130 and a lower backing ring 150 disposed on the central mandrel 20 between the packer ring 40 and the upper and lower slip rings 60 and 80, respectively. In one aspect, the upper and lower backing rings 130 and 150 can be disposed on the central mandrel 20 between the packer ring 40 and the upper and lower cones 100 and 110, respectively. The upper and lower backing rings 130 and lower 150 can be sized so as to bind and retain opposite ends 44 and 46 of the packer ring 40.

Each of the upper and lower backing rings 130 and 150 can also include a plurality of backing segments 132 and 152 that are disposed circumferentially around the backing rings 130 and 150 and the central mandrel 20 when the backing rings are placed on the central mandrel. Additionally, a plurality of fracture regions 134 and 154 can be disposed between respective backing segments 132 and 152. The plurality of fracture regions 134 and 154 can join the backing segments 132 and 152 together and form the backing rings 130 and 150. The fracture regions 134 and 154 can fracture the upper and lower backing rings 130 and 150 into the plurality of backing segments 132 and 152 when the axial load induces stress in the fracture regions 134 and 154.

The backing segments 132 and 152 can be sized and shaped to reduce longitudinal extrusion of the packer ring 40 when the packer ring is compressed to form the seal between the central mandrel 20 and the well bore wall or casing. It will be appreciated that the temperature and pressure conditions of the well bore can exceed the glass transition and/or melting points of the elastomeric material of the packing ring. If this occurs the packer ring 40 can soften or melt and extrude along the longitudinal axis of the central mandrel such that the seal formed by the packer ring between the well bore wall or casing and the central mandrel can be compromised. Thus, advantageously, the backing segments can contain the packer ring 40 so as to reduce longitudinal extrusion of the packer along the central mandrel 20.

An upper cone 100 and a lower cone 110 can be disposed on the central mandrel 20 adjacent the upper and lower backings rings 130 and 150, respectively. Each of the upper and lower cones 100 and 110 can be sized and shaped to induce stress into the upper or lower backing rings 130 and 150, respectively, to cause the backing ring to fracture into the plurality of backing segments 134 and 154 when the axial load is applied to the upper slip ring 60. In one aspect, the upper and lower cones 100 and 110 can be an opposite conical face 108 and 118 on the upper and lower cones 100 and 110 disposed under the upper and upper and lower slip rings 60 and 80, respectively, as described above.

Additionally, a plurality of spacers 170, such as pins can be disposed about the upper and lower cones 100 and 110 associated with the upper and lower backing rings 130 and 150. The spacers 170 can correspond to the fracture regions 134 and 154 in the upper and lower backing rings and can transfer an applied load from the upper or lower cones 100 and 110 to the fracture regions 134 and 154 of the upper or lower backing rings, respectively. Advantageously, the applied load transferred to the upper and lower backing rings can reduce uneven fracturing of the backing rings into backing segments 132 and 152. Additionally, the spacers 170 can hold the individual backing segments 132 and 152 into substantially uniformly spaced circumferential positions around the upper and lower cones 100 and 110, respectively. The spacers are secured in holes 172 on the opposite conical face 108.

It is a particular advantage of the down hole flow control device 10 of the present invention that the fracture regions 134 and 154 and spacers 170 of the backing rings 130 and 150 and cones 100 and 110 can separate the backing ring into similarly sized and shaped backing segments 132 and 152 that can be distributed substantially evenly around the circumference of the central mandrel 20. Thus, gaps between the separated backing segments 132 and 152 can be substantially even spaced, in contrast to larger gaps between segments on one side of the central mandrel and smaller gaps on an opposite side of the central mandrel, as might occur without the presence of the fracture regions 134 and 154 and spacers 170. In this way, the evenly spaced backing segments and gaps can advantageously reduce the likelihood of the packer ring 40 extruding along the longitudinal axis 32 of the central mandrel 20 through a relatively larger gap between the backing segments, and, thus, can provide an additional containment of the packer rings.

Figure 1B:
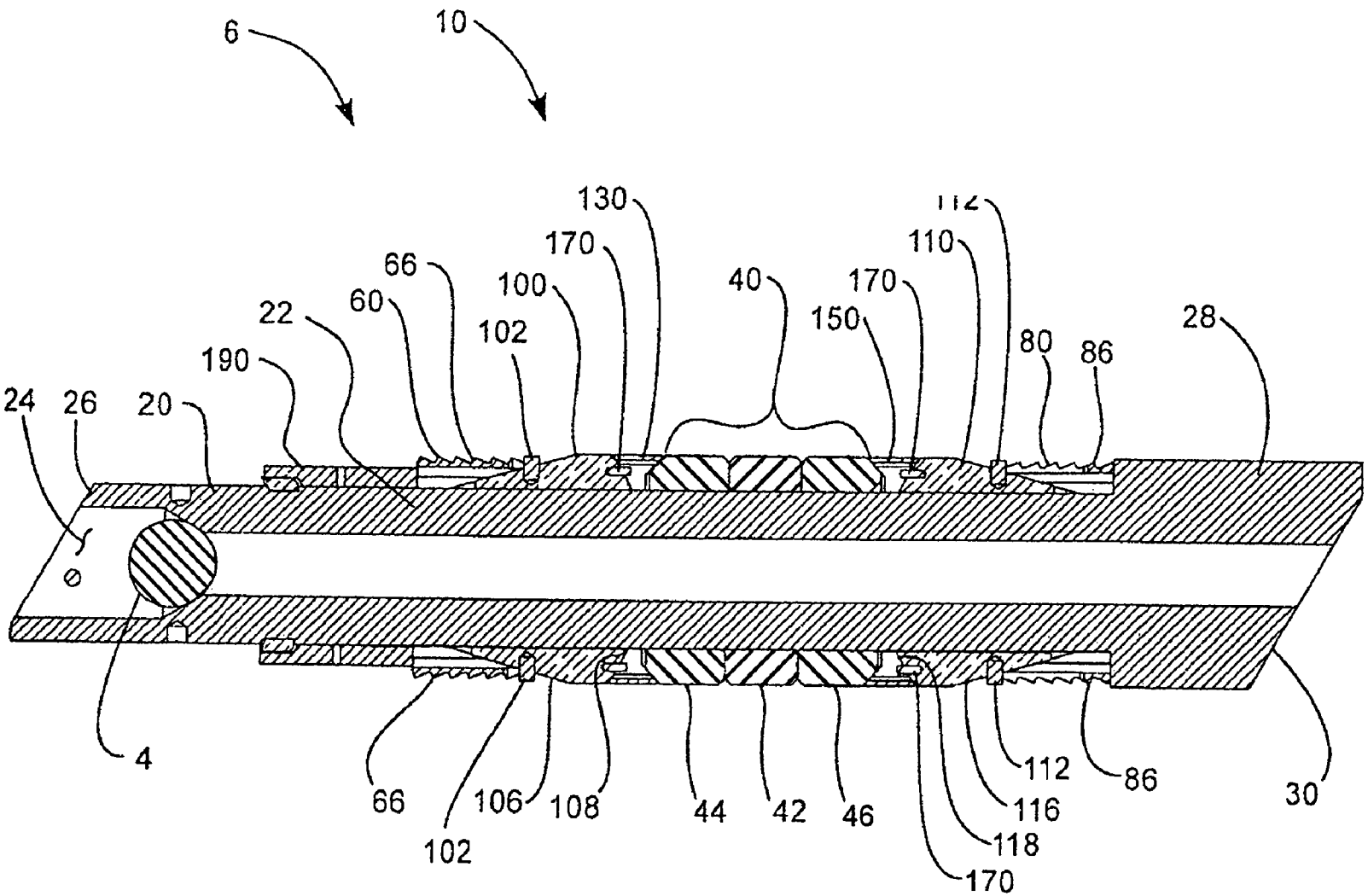
FIG. 1*b* is a cross section view of the down hole flow control device of FIG. 1*a;*
Figure 2A:
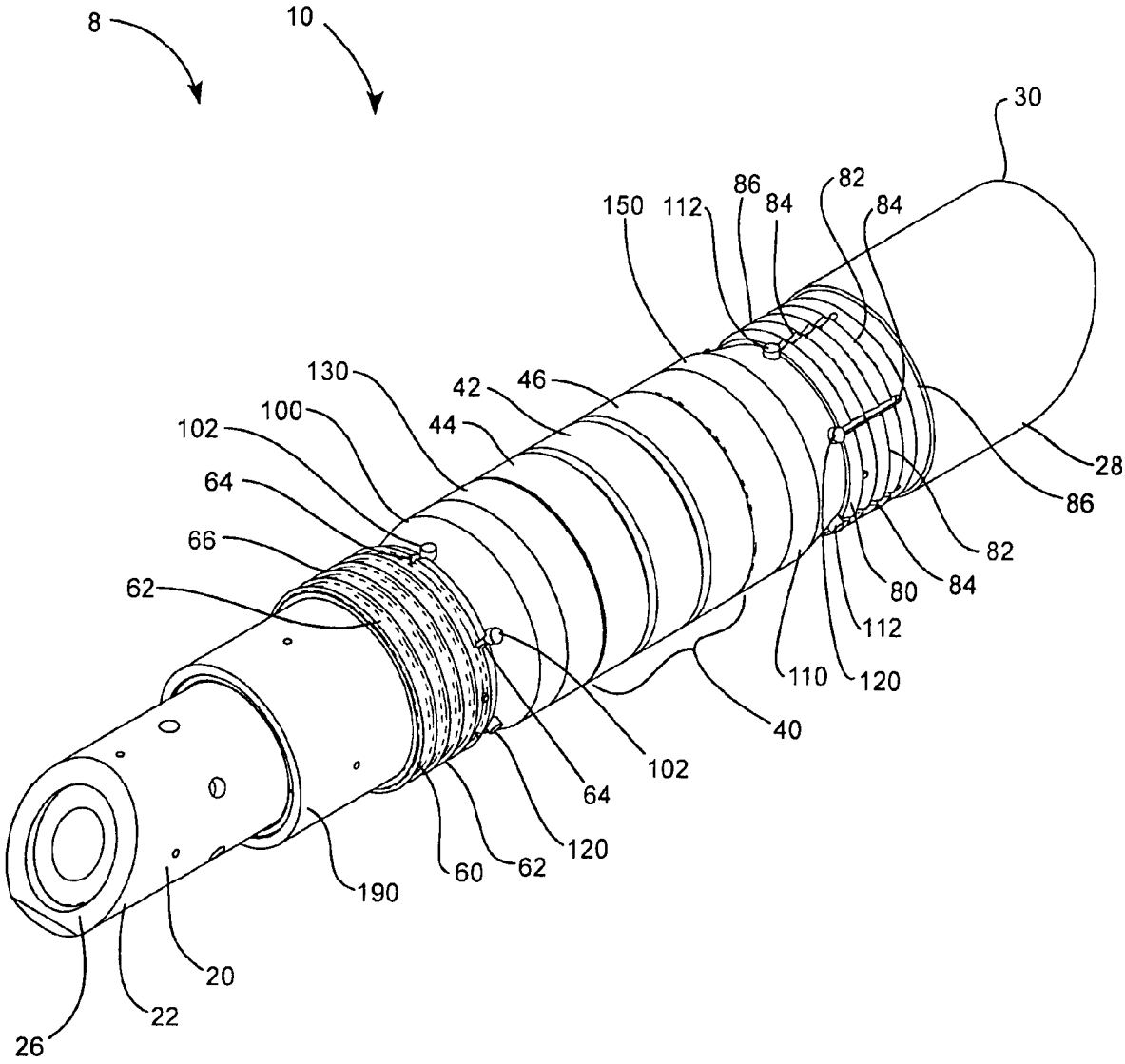
FIG. 2*a* is a perspective view of the down hole flow control device of FIG. 1*a* shown in use with a bridge plug down hole tool.
Figure 2B:
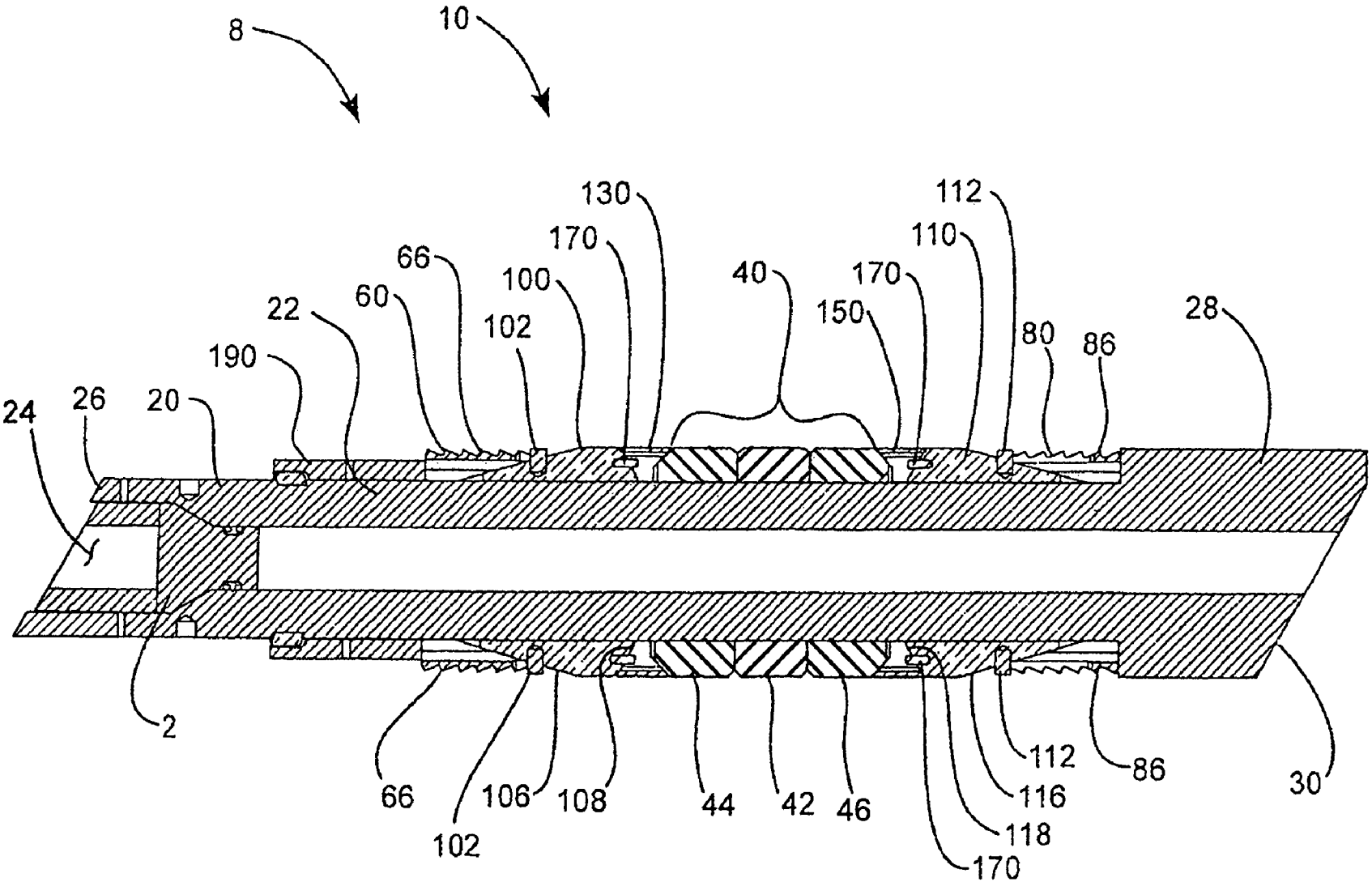
FIG. 2*b* is a cross section view of the down hole tool of FIG. 3*a;*
Figure 3:
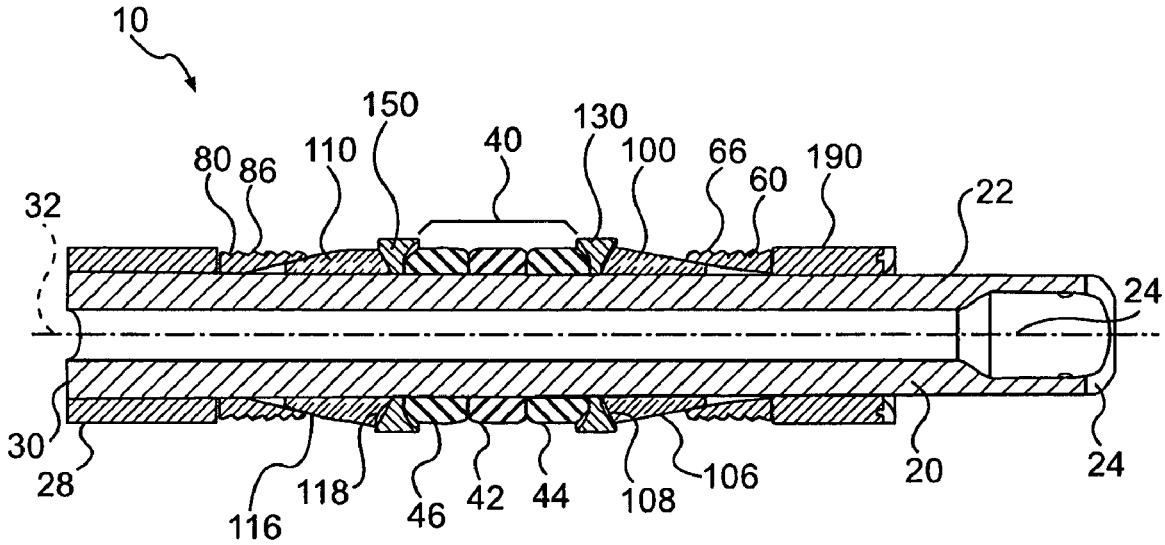
FIG. 3 is a schematic cross sectional view of the down hole flow control device of FIG. 1*a* shown in an uncompressed configuration.
Figure 4:
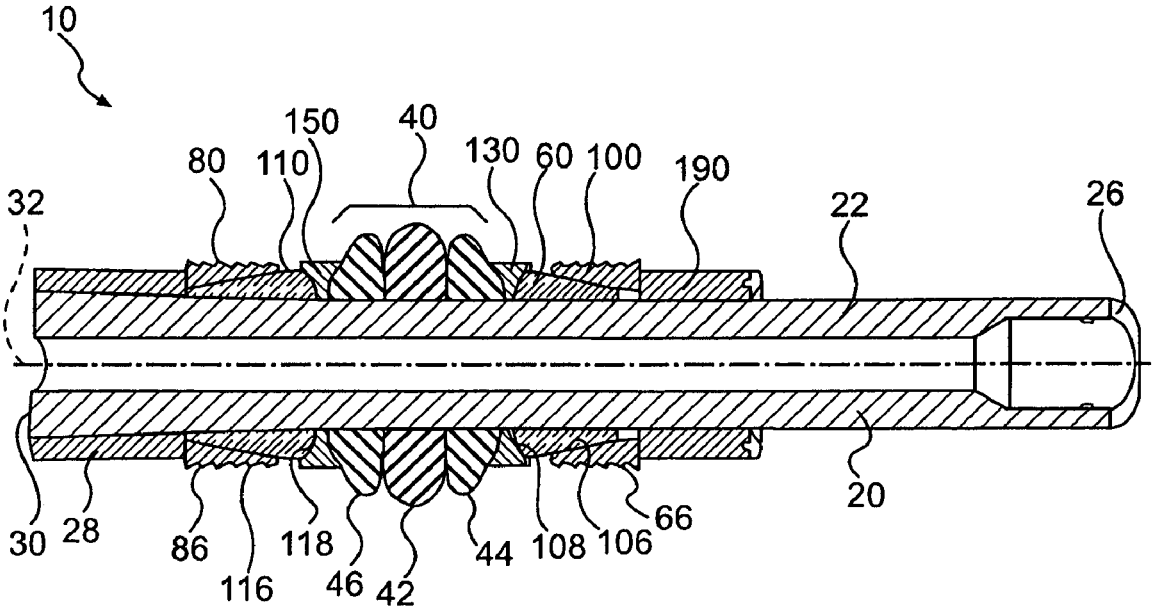
FIG. 4 is a schematic cross sectional view of the down hole flow control device of FIG. 1*a* shown in a compressed configuration.
Figure 5:
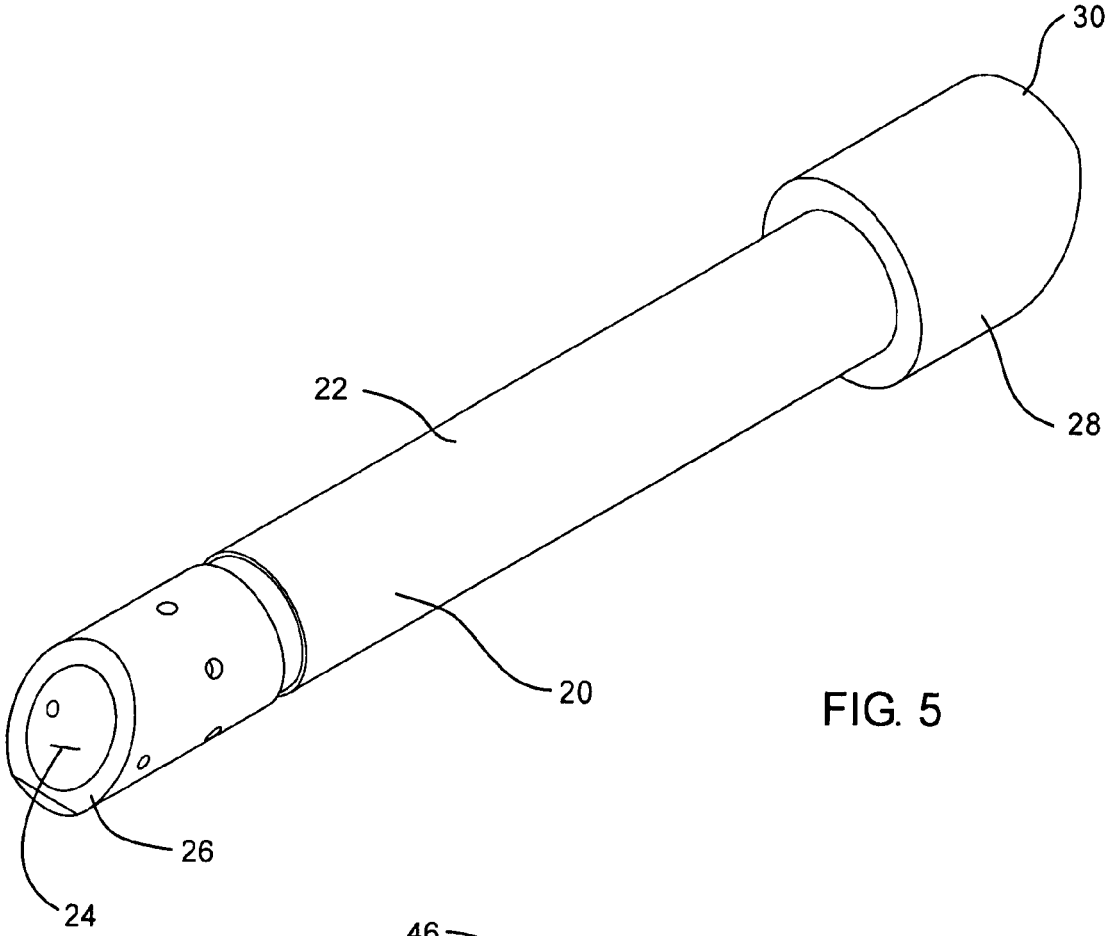
FIG. 5 is a perspective view of a central mandrel of the down hole flow control device of FIG. 1*a;*
Figure 6:
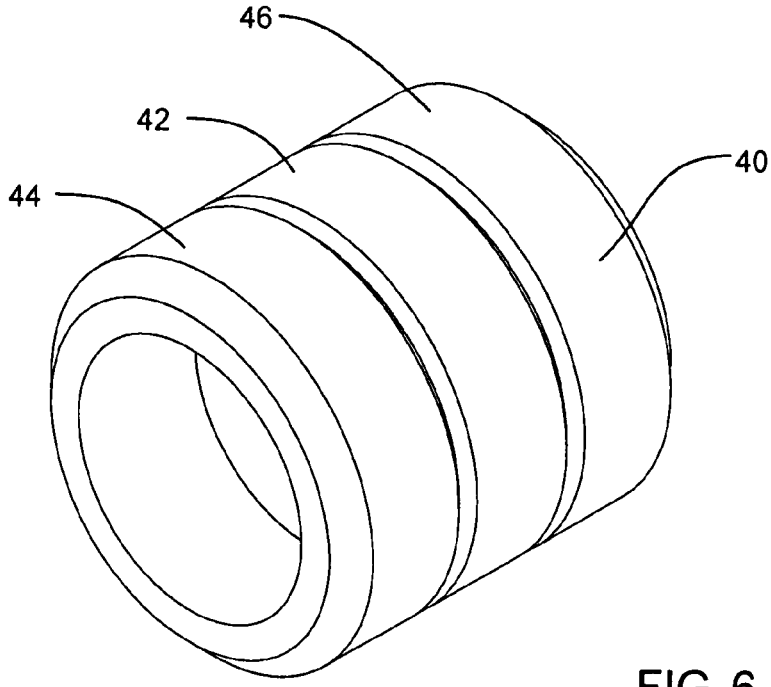
FIG. 6 is a perspective view of a packer ring of the down hole flow control device of FIG. 1*a;*
Figure 7:
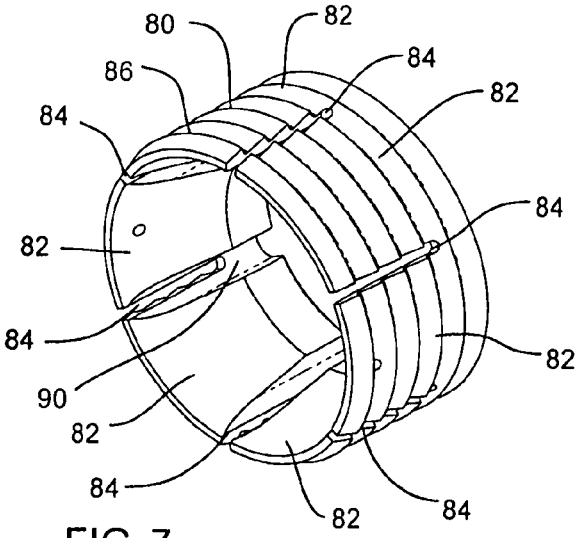
FIG. 7 is a perspective view of a lower slip ring of the down hole flow control device of FIG. 1*a;*
Figure 9:
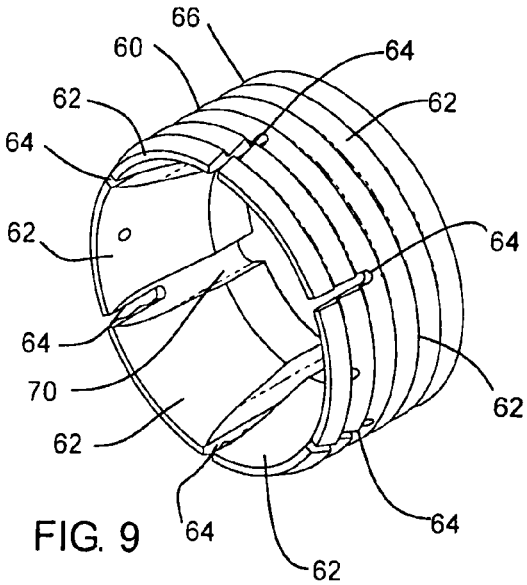
FIG. 9 is a perspective view of an upper slip ring of the down hole flow control device of FIG. 1*a;*
Figure 8:
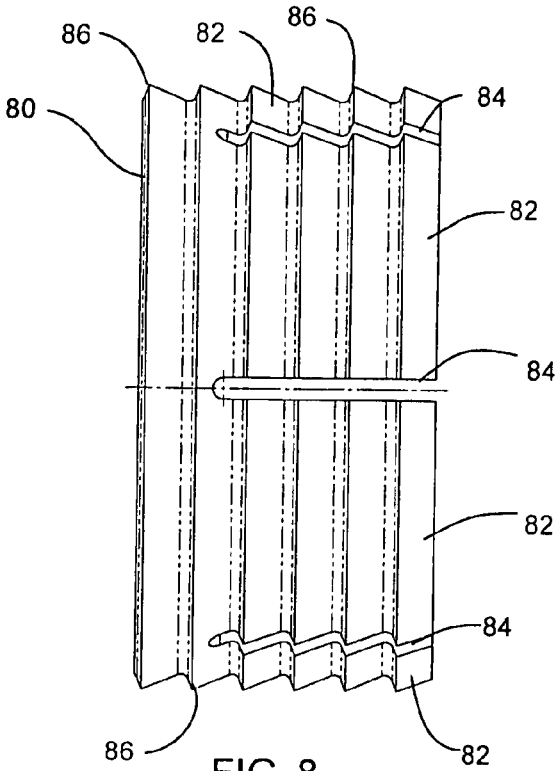
FIG. 8 is a side view of the lower slip ring of FIG. 7.
Figure 10:
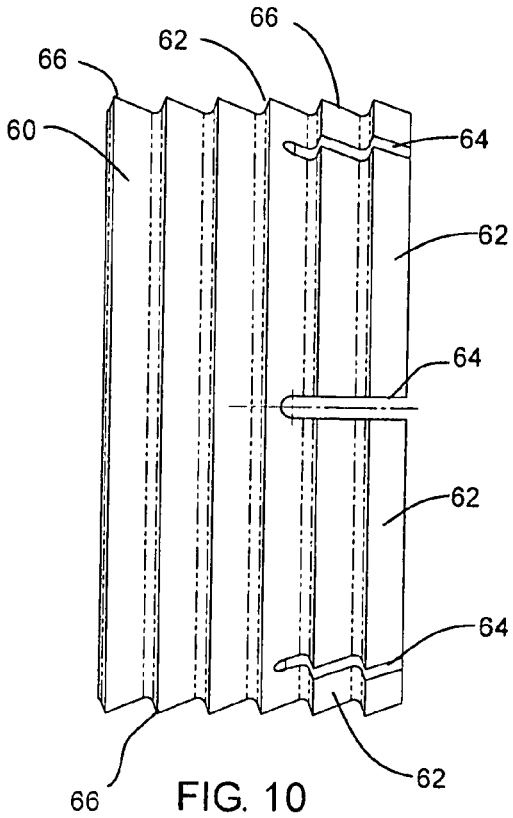
FIG. 10 is a side view of the upper slip ring of FIG. 11.
Figure 11:
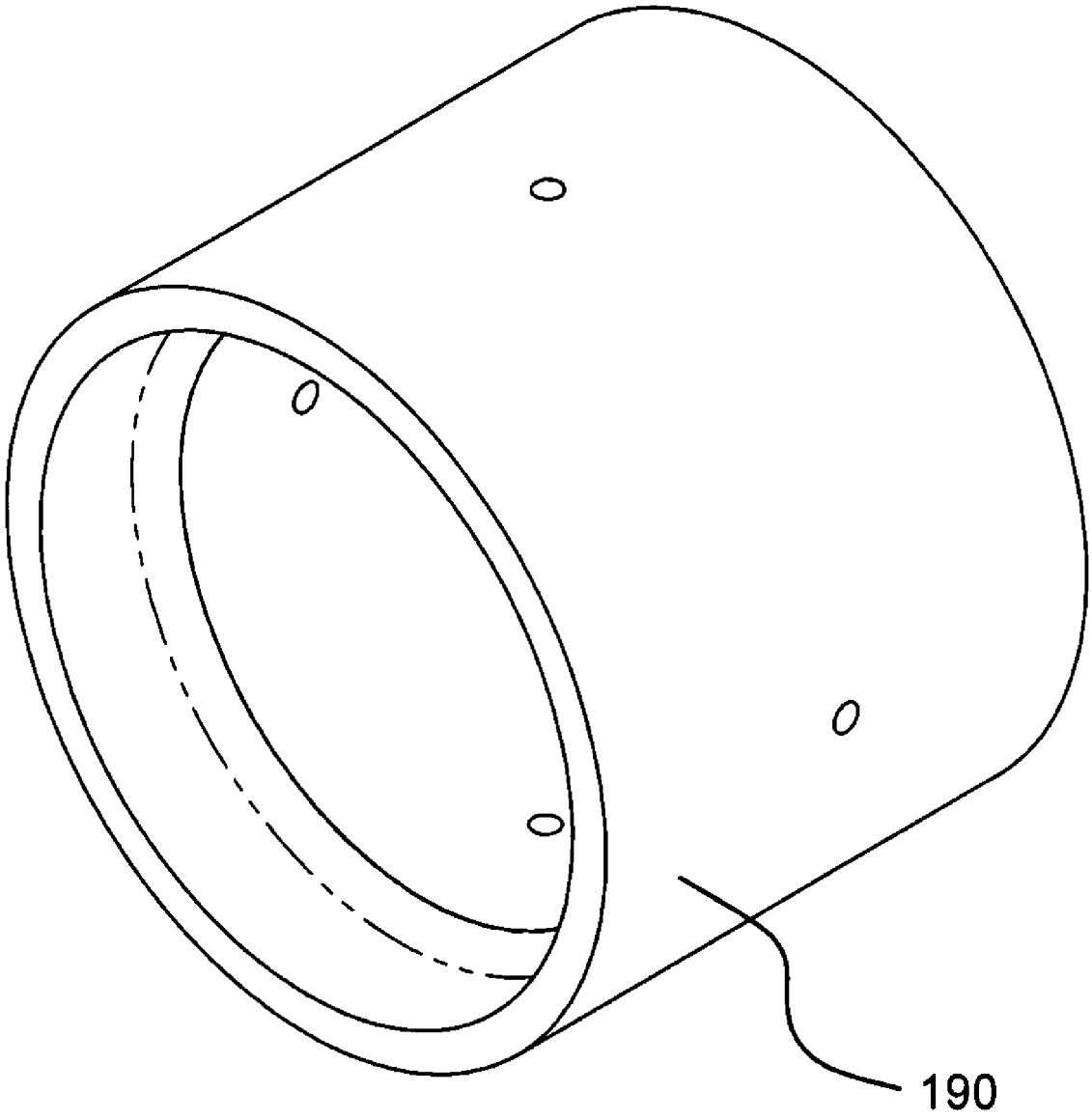
FIG. 11 is a perspective view of a movable top stop of the down hole flow control device of FIG. 1*a;*
Figure 12:
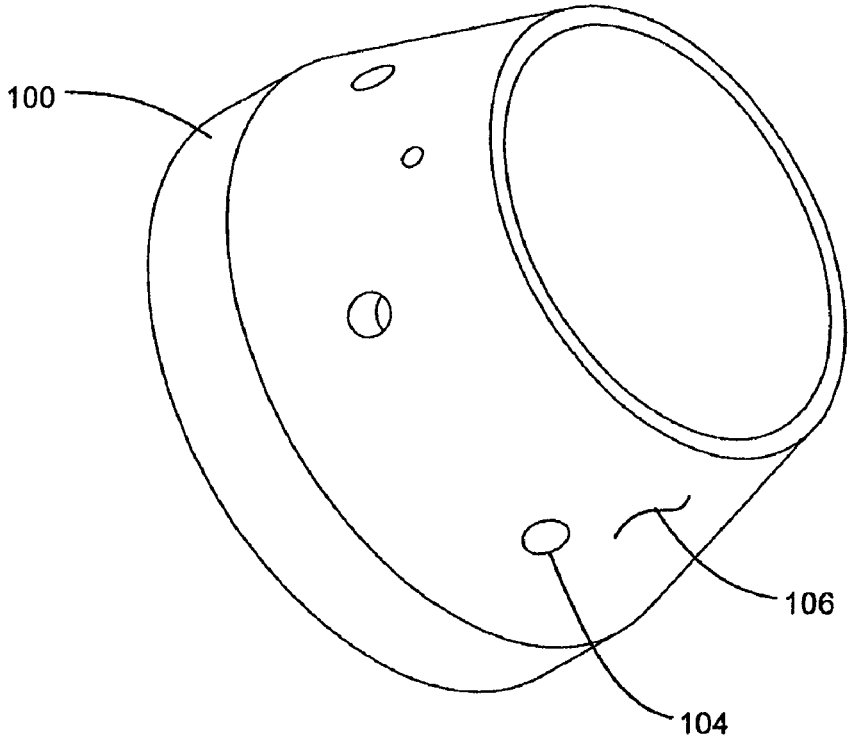
FIG. 12 is a perspective view of an upper or lower cone of the down hole flow control device of FIG. 1*a;*
Figure 13:
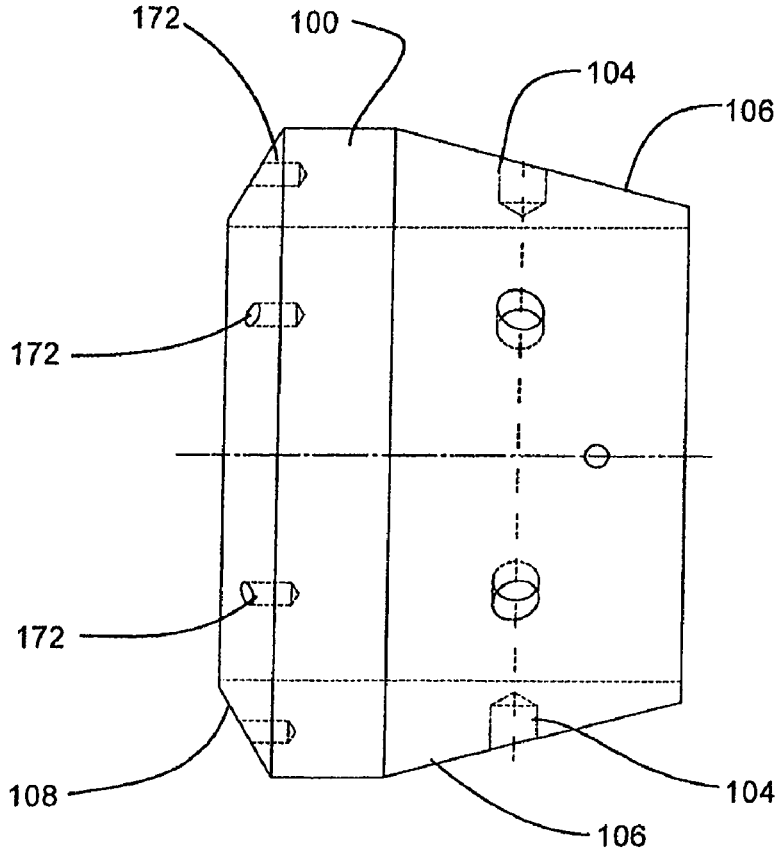
FIG. 13 is a side view of the upper or lower cone of FIG. 14.
Figure 14A:
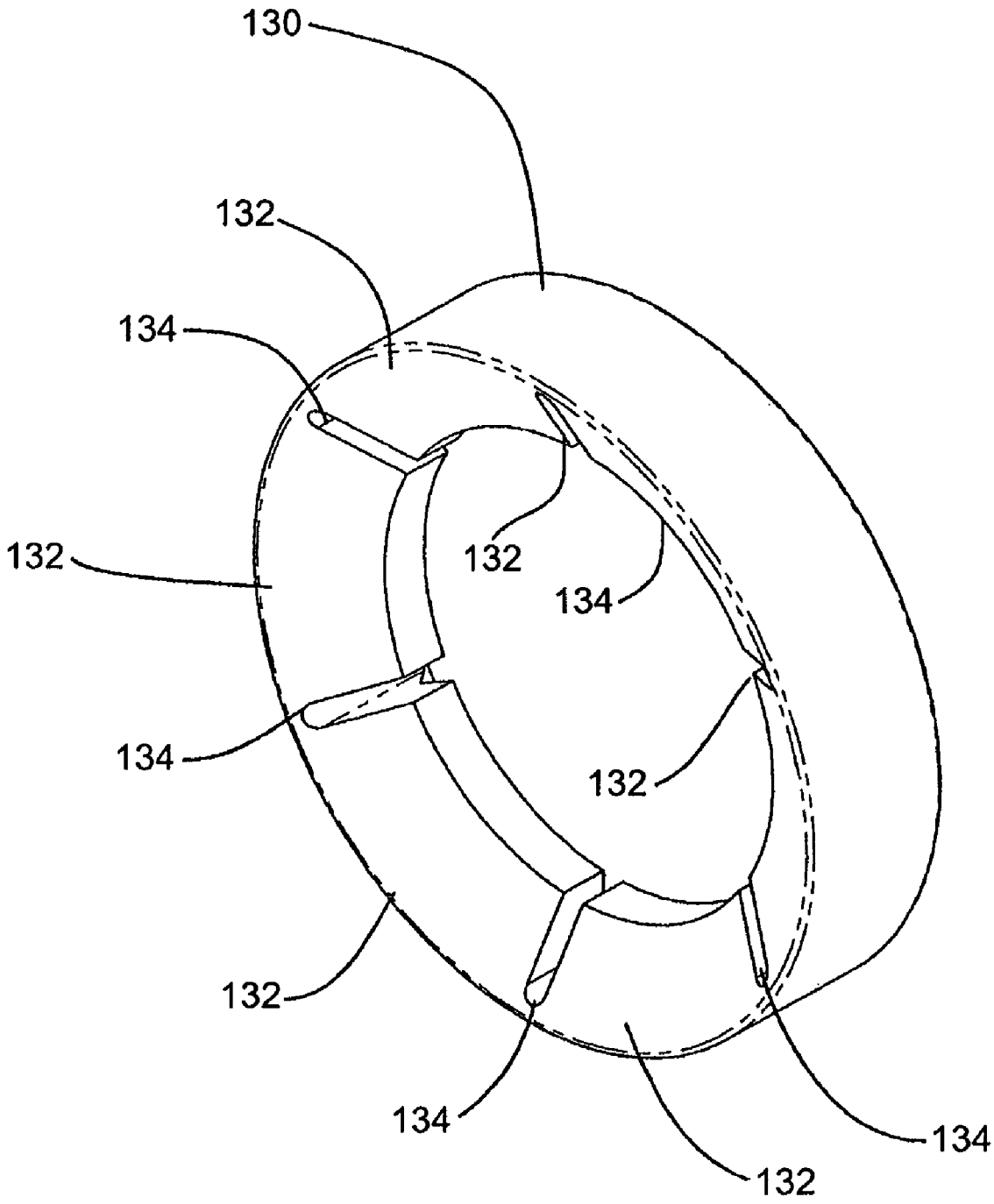
FIG. 14*a* is a perspective view of an upper backing ring of the down hole flow device of FIG. 1*a;*
Figure 14B:
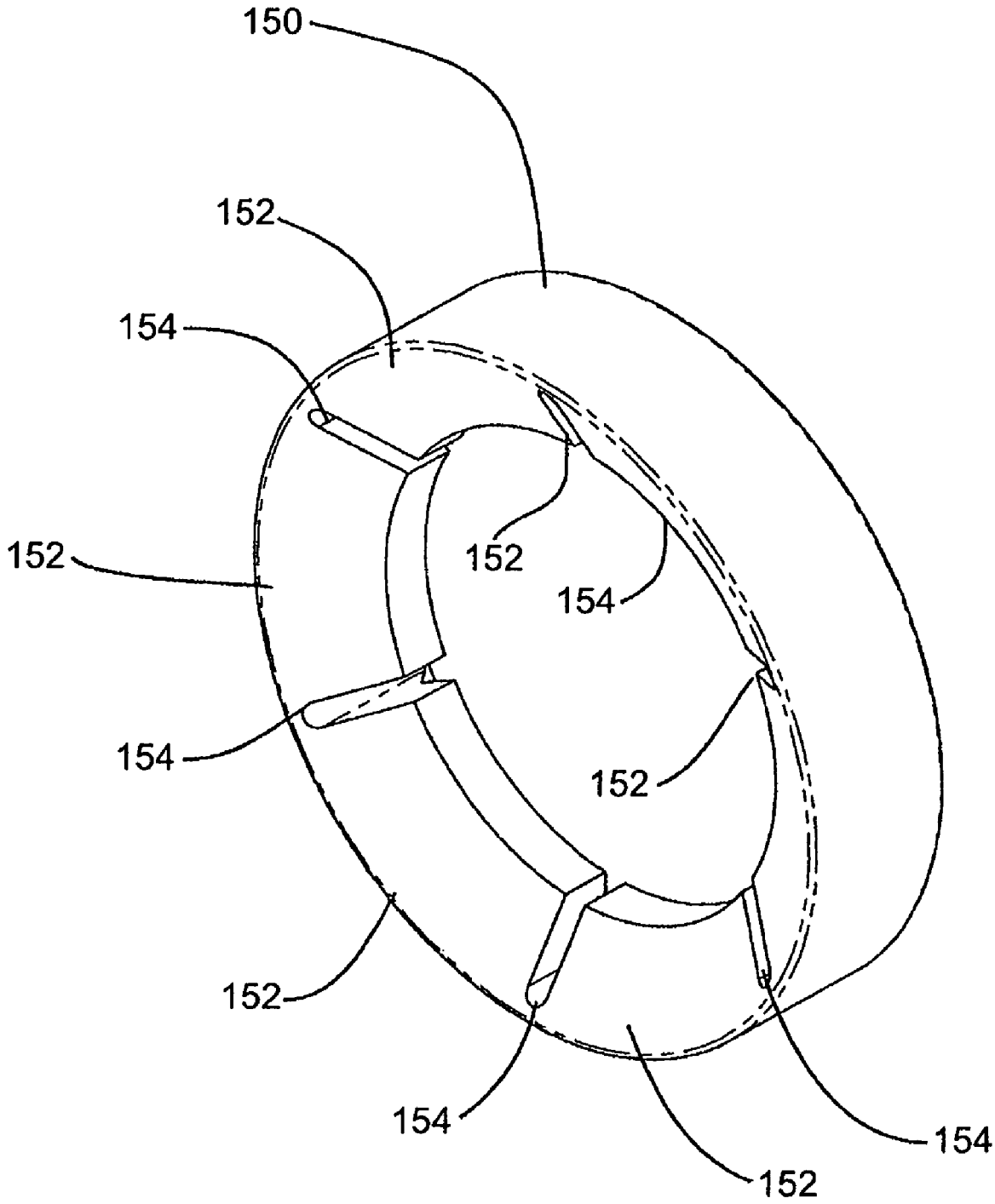
FIG. 14*b* is a perspective view of a lower backing ring of the down hole flow device of FIG. 1*a;*

It will be appreciated that the down hole flow control device 10 described herein can be used with a variety of down hole tools. Thus, as indicated above, FIGS. 1*a*-1*b* show the down hole flow control device 10 used with a frac plug, indicated generally at 6, and FIGS. 2*a*-2*b* show the down hole flow control device 10 used with a bridge plug, indicated generally at 8. Referring to FIGS. 1*a*-1*b* the down hole flow control device, indicated generally at 10 can secure or anchor the central mandrel 22 to the well bore wall or casing so that a one way check valve 4, such as a ball valve, can allow flow of fluids from below the plug while isolating the zone below the plug from fluids from above the plug. Referring to FIGS. 2*a*-2*b*, the down hole flow control device, indicated generally at 10, can secure or anchor the central mandrel to the well bore wall or casing so that a solid plug 2 can resist pressure from either above or below the plug in order to isolate the a zone in the well bore. Advantageously, the down hole flow control device 10 described herein can be used for securing other down hole tools such as cement retainers, well packers, and the like.

Figure 15:
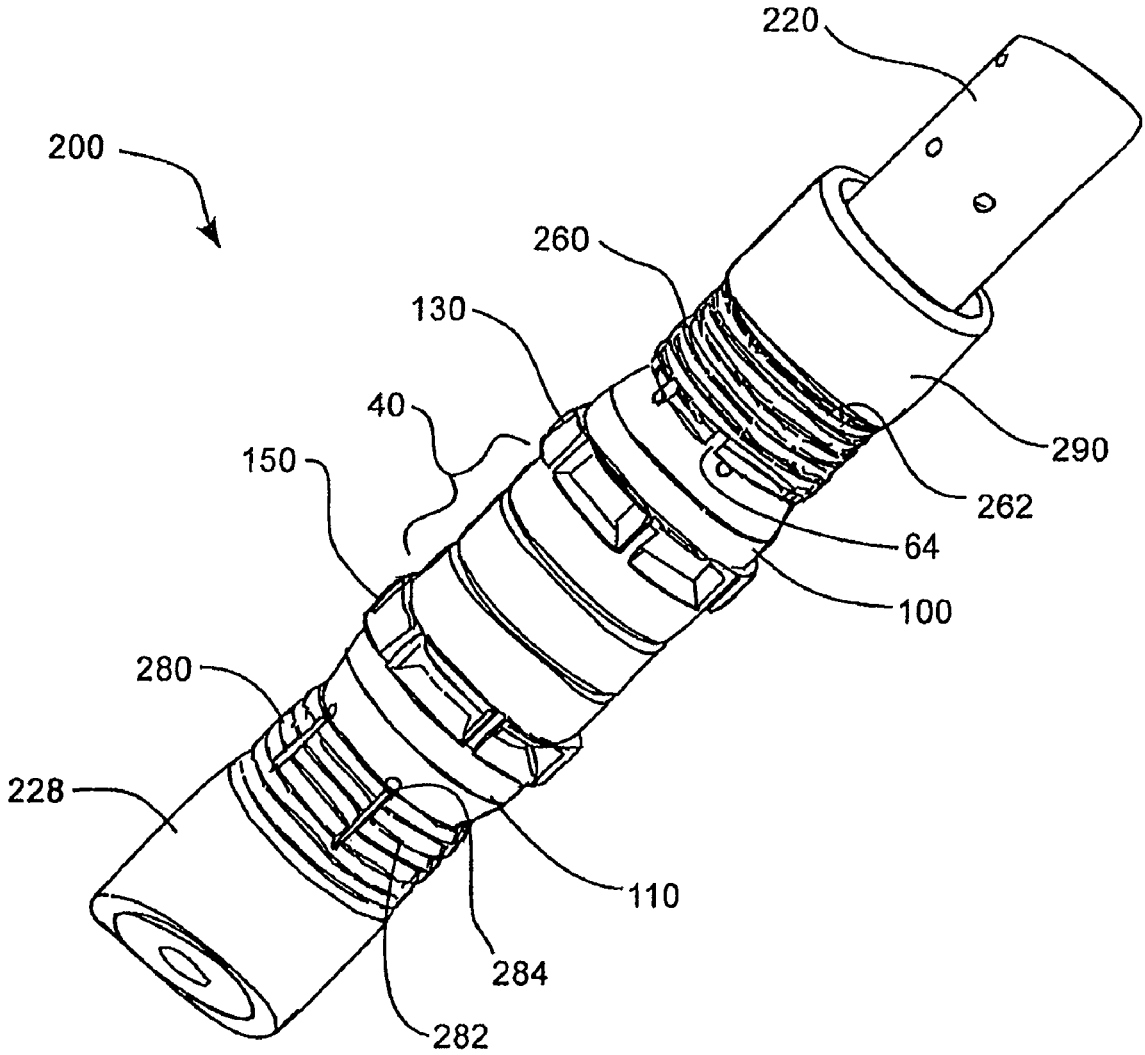
FIG. 15 is a side view of the present invention.
Figure 16:
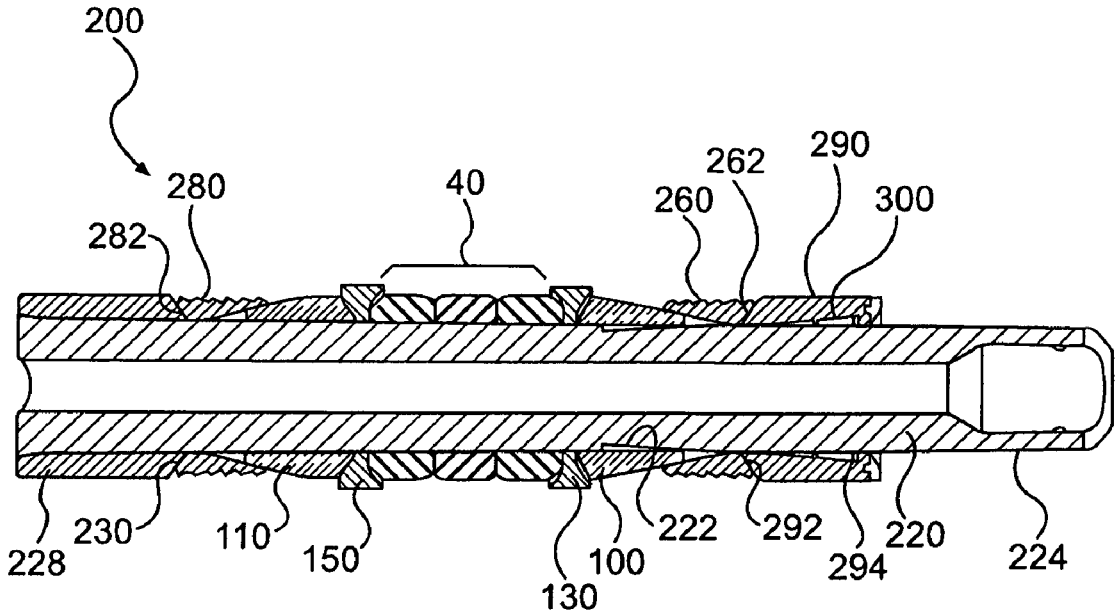
FIG. 16 is a perspective view of the down hole flow control device of FIG. 1*a;*
Figure 17:
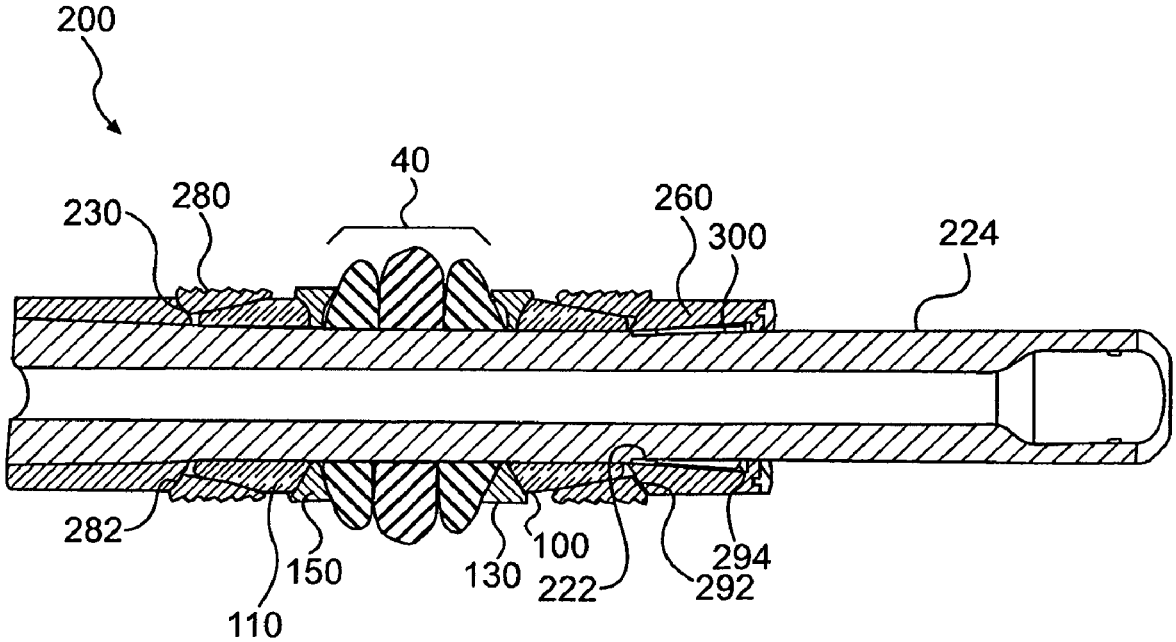
FIG. 17 is a schematic cross sectional view of the down hole flow control device of FIG. 17 shown in a compressed configuration.

As illustrated in FIGS. 15-17, a down hole flow control device, indicated generally at 200, is shown in accordance an embodiment of the present invention for use in flow control in a well bore as a down hole tool, such as a frac plug, a bridge plug, a cement retainer, well packer, and the like, in a well bore as used in a gas or oil well. The down hole flow control device 200 can be similar in many respects to the down hole flow device 10 described above and shown in FIGS. 1*a*-14. Thus, the down hole flow control device 200 can include a central mandrel 200, and compressible packer ring 40, an upper slip ring 260, and lower slip ring 280. Additionally, the down hole flow control device can have an anvil 228, a top stop 290, and a tapered wedge ring 300.

The anvil 228 can be coupled to the central mandrel 220 adjacent the lower slip ring 280. The anvil 228 can have a tapered slip ring engagement surface 230 that can engage a corresponding tapered surface 282 of the lower slip ring 280. The tapered engagement surface 230 of the anvil 228 can translate axial forces from the axial loading to outward radial forces in the lower slip ring 280. In this way, the lower slip ring 280 can experience outward radial forces from both the lower cone 110 and the anvil 228. Advantageously, increasing the outward radial forces in the lower slip ring 280 can promote evenly spaced longitudinal fractures in the fracture regions 84 of the lower slip ring 280.

The top stop 290 can be movably disposed on the central mandrel 220 adjacent the upper slip ring 260. Similar to the anvil 228, the top stop 290 can have a tapered slip ring engagement surface 292 that can engage a corresponding tapered surface 262 of the upper slip ring 260. The tapered engagement surface 292 of the top stop 290 can translate axial forces from the axial loading to outward radial forces in the upper slip ring 260. In this way, the upper slip ring 260 can experience outward radial forces from both the upper cone 100 and the top stop 290. Advantageously, increasing the outward radial forces in the upper slip ring 260 can promote evenly spaced longitudinal fractures in the fracture regions 64 of the upper slip ring 260. Additionally, the corresponding tapered surfaces of the anvil and lower slip ring, and the top stop and upper slip ring can be sized and shaped to translate forces from the axial load to radial forces on the slip segments in order to wedge and secure the slip segments against the well bore.

The top stop 290 can also have a tapered cut out 294 extending circumferentially around an inner surface 296 of the top stop. Additionally, the central mandrel 220 can have a similar tapered cut out 222 extending circumferentially around an outer surface 224 of the central mandrel. A tapered wedge ring 300 can be disposed around the central mandrel 220 and inside the tapered cut 292 out of the top stop 290 when the top stop 290 is disposed on the central mandrel 220. The wedge ring 300 can be movable with the top stop 290 so as to engage the tapered cut out 222 of the central mandrel 220 as the top stop 290 moves downward along the longitudinal axis of the central mandrel 220. In this way, the wedge ring 300 can wedge between the tapered cut out 292 of the top stop 290 and the tapered cut out 222 of the central mandrel 220 so as to secure the top stop on the central mandrel and limit axial movement of the down hole tool.

It is a particular advantage of the down hole flow control device 200 that axial movement of the top stop 290 is limited by the wedge ring 300. Occasionally, vibration, rotation, and other forces on down hole anchors in use in well bores can cause a reverse ratcheting effect that can loosen the grip of the upper slip segments 62 when no upper stop or limit restricts axial movement of the slip segments back up the central mandrel. Thus, advantageously, the wedge ring 300 can act as an anchor to the top stop 290 to secure the top stop in place and limit the upward movement of the upper slip segments 62 and packer ring 40. In one aspect, the upward movement of the upper slip segments 62 and packer ring 40 can be limited to less than about 3 inches. This limited upward axial movement of the upper slip segments and packer ring helps to maintain the integrity of the seal formed by the packer ring between the well bore wall or casing and the central mandrel.

The present invention also provides for a method for flow control in a well bore as a down hole tool including lowering a down hole flow control device into a well bore. The down hole flow control device can include a central mandrel sized and shaped to fit within a well bore. The central mandrel can have a packer ring disposed on the central mandrel. The packer ring can also be compressible along a longitudinal axis of the central mandrel so as to form a seal between the central mandrel and the well bore. The down hole flow control device can also include an upper slip ring and a lower slip ring disposed on the central mandrel with the upper slip ring disposed above the packer ring and the lower slip ring disposed below the packer ring. Each of the upper and lower slip rings can include a plurality of slip segments joined together by fracture regions to form the ring. The fracture regions can be configured to facilitate longitudinal fractures so as to break the slip rings into the plurality of slip segments. The upper and lower slip rings can also have different fracture regions from one another so as to induce sequential fracturing with respect to the upper and lower slip rings when an axial load is applied to both the upper slip ring and the lower slip ring. Additionally, each of the plurality of slip segments can be configured to secure the down hole flow control device in the well bore. The method can also include applying a downward force on a movable top stop of the down hole flow control device to sequentially compress the upper and lower slip rings and the packer ring so as to break the lower slip ring into slip segments to secure the flow control device to the well bore, to form a seal between the central mandrel and the well bore by compressing the packer ring, and to break the upper slip ring into slip segments to further secure the flow control device to the well bore after the packer ring has been compressed to form the seal.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the slip rings, the fracture regions being configured to facilitate longitudinal fractures to break the slip rings into the plurality of slip segments, and each of the plurality of slip segments being configured to secure the down hole flow control device in the well bore;

c) the upper and lower slip rings having different fracture regions from one another to induce sequential fracturing with respect to the upper and lower slip rings when an axial load is applied to both the upper slip ring and the lower slip ring;

d) an upper backing ring and a lower backing ring disposed on the central mandrel between the packer ring and the upper and lower slip rings, respectively, each of the upper and lower backing rings further including:

i) a plurality of backing segments disposed circumferentially around the central mandrel; and ii) a plurality of fracture regions disposed between respective backing segments, the fracture regions being configured to fracture the upper and lower backing rings into the plurality of backing segments when the axial load induces stress in the fracture regions, and the backing segments being sized and shaped to reduce longitudinal extrusion of the packer ring when the packer ring is compressed to form the seal between the central mandrel and the well bore;

e) an upper cone and a lower cone disposed on the central mandrel adjacent the upper and lower backing rings, respectively, each of the upper and lower cones being sized and shaped to induce stress into the upper an lower backing ring, respectively, to cause the backing ring to fracture into the plurality of backing segments when the axial load is applied to the upper slip ring; and f) a plurality of spacers disposed about the upper and lower cones, the spacers corresponding the fracture regions in the upper and lower backing rings to transfer an applied load from the upper and lower cone to the fracture point of the upper and lower backing rings to reduce uneven fracturing of the backing rings into backing segments.

2. A device in accordance with claim 1, wherein the fracture region of the lower slip ring is configured to fracture before the upper slip ring under the axial load so as to induce fracture of the lower slip ring before the upper slip ring under the axial load.

3. A device in accordance with claim 1, wherein the fracture regions include thinned portions of the slip segments and wherein the fracture regions of the lower slip ring are thinner than the fracture regions of the upper slip ring.

4. A device in accordance with claim 1, wherein the upper slip ring continues to move axially along the central mandrel under the axial load after the slip segments from the lower slip ring secure the down hole flow control device in the well bore.

5. A device in accordance with claim 1, further comprising:

a) an anvil coupled to the central mandrel adjacent the lower slip ring, the anvil having a tapered slip ring engagement surface to engage a corresponding tapered surface of the lower slip ring;

b) a top stop movably disposed on the central mandrel adjacent the upper slip ring, and having a tapered slip ring engagement surface to engage a corresponding tapered surface of the upper slip ring; and c) the corresponding tapered surfaces being sized and shaped to translate forces from the axial load to radial forces on the slip segments to wedge and secure the slip segments against the well bore.

6. A device in accordance with claim 1, wherein the mandrel includes a fiber and resin composite material including a resin selected from the group consisting of a tetrafunctional epoxy resin with an aromatic diamine curative, bismaleimide, phenolic, thermoplastic, and combinations thereof; and fibers selected from the group consisting of E-type glass fibers, ECR type glass fibers, carbon fibers, mineral fibers, silica fibers, basalt fibers, and combinations thereof.

7. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the slip rings, the fracture regions being configured to facilitate longitudinal fractures to break the slip rings into the plurality of slip segments, and each of the plurality of slip segments being configured to secure the down hole flow control device in the well bore;

c) an anvil coupled to the central mandrel adjacent the lower slip ring, the anvil having a tapered slip ring engagement surface to engage a corresponding tapered surface of the lower slip ring;

d) a top stop movably disposed on the central mandrel adjacent the upper slip ring, and having a tapered slip ring engagement surface to engage a corresponding tapered surface of the upper slip ring;

e) the corresponding tapered surfaces being sized and shaped to translate forces from the axial load to radial forces on the slip segments to wedge and secure the slip segments against the well bore;

f) a tapered cut out extending circumferentially around an inner surface of the top stop; b) a tapered cut out extending circumferentially around an outer surface of the central mandrel; c) a tapered wedge ring disposed around the central mandrel and inside the tapered cut out of the top stop when the top stop is disposed on the central mandrel; and g) the wedge ring being movable with the top stop so as to engage the tapered cut out of the central mandrel as the top stop moves downward axially along the central mandrel such that the wedge ring wedges between the tapered cut out of the top stop and the tapered cut out of the central mandrel to secure the top stop on the central mandrel.

8. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the ring, the fracture regions being configured to facilitate longitudinal fractures to break the slip rings into the plurality of slip segments, and each of the plurality of slip segments being configured to secure the down hole flow control device in the well bore;

c) an upper cone and a lower cone disposed on the central mandrel adjacent the upper slip ring and the lower slip ring, respectively, each of the upper and lower cones being sized and shaped to induce stress into the upper and lower slip rings, respectively, to cause the slip rings to fracture into slip segments when an axial load is applied to the slip rings;

d) a plurality of stress inducers disposed about the upper and lower cones, each stress inducer corresponding to a respective fracture region in the upper and lower slip rings, and sized and shaped to transfer an applied load from the upper and lower cone to the fracture region of the upper and lower slip rings to reduce uneven fracturing of the slip rings into slip segments and to provide substantially even circumferential spacing of the slip segments;

e) an anvil coupled to the central mandrel adjacent the lower slip ring, the anvil having a tapered slip ring engagement surface to engage a corresponding tapered surface of the lower slip ring;

f) a top stop movably disposed on the central mandrel adjacent the upper slip ring, and having a tapered slip ring engagement surface to engage a corresponding tapered surface of the upper slip ring;

g) the corresponding tapered surfaces being sized and shaped to translate forces from the axial load to radial forces on the slip segments to wedge and secure the slip segments against the well bore;

h) a tapered cut out extending circumferentially around an inner surface of the top stop;

i) a tapered cut out extending circumferentially around an outer surface of the central mandrel;

j) a tapered wedge ring disposed around the central mandrel and inside the tapered cut out of the top stop when the top stop is disposed on the central mandrel; and k) the wedge ring being movable with the top stop so as to engage the tapered cut out of the central mandrel as the top stop moves downward axially along the central mandrel such that the wedge ring wedges between the tapered cut out of the top stop and the tapered cut out of the central mandrel to secure the top stop on the central mandrel and limit axial movement of the down hole tool.

9. A device in accordance with claim 8, wherein the fracture region of the lower slip ring is configured to fracture before the upper slip ring under the axial load so as to induce fracture of the lower slip ring before the upper slip ring under the axial load.

10. A device in accordance with claim 8, wherein the upper slip ring continues to move axially along the central mandrel under the axial load after the slip segments from the lower slip ring secure the down hole flow control device in the well bore.

11. A device in accordance with claim 8, further comprising:

a) an upper backing ring and a lower backing ring disposed on the central mandrel between the packer ring and the upper and lower slip rings, respectively, each of the upper and lower backing rings further including:

i) a plurality of backing segments disposed circumferentially around the central mandrel; and ii) a plurality of fracture regions disposed between respective backing segments, the fracture regions being configured to fracture the upper and lower backing rings into the plurality of backing segments when the axial load induces stress in the fracture regions, and the backing segments being sized and shaped to reduce longitudinal extrusion of the packer ring when the packer ring is compressed to form the seal between the central mandrel and the well bore.

12. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the slip rings, the fracture regions being configured to facilitate longitudinal fractures to break the slip rings into the plurality of slip segments, and each of the plurality of slip segments being configured to secure the down hole flow control device in the well bore;

c) an upper backing ring and a lower backing ring disposed on the central mandrel between the packer ring and the upper and lower slip rings, respectively, each of the upper and lower backing rings further including:

i) a plurality of backing segments disposed circumferentially around the central mandrel; and ii) a plurality of fracture regions disposed between respective backing segments, the fracture regions being configured to fracture the upper and lower backing rings into the plurality of backing segments when an axial load induces stress in the fracture regions, and the backing segments being sized and shaped to reduce longitudinal extrusion of the packer ring when the packer ring is compressed to form the seal between the central mandrel and the well bore;

d) an upper cone and a lower cone disposed on the central mandrel adjacent the upper and lower backing rings, respectively, each of the upper and lower cones being sized and shaped to induce stress into the upper and lower backing rings, respectively, to cause the backing rings to fracture into the plurality of backing segments when the axial load is applied to the backing rings; and e) a plurality of spacers disposed about the upper and lower cones, the spacers corresponding the fracture regions in the upper and lower backing rings to provide substantially even circumferential spacing of the backing segments.

13. A device in accordance with claim 12, wherein the fracture region of the lower slip ring is configured to fracture before the upper slip ring under the axial load so as to induce fracture of the lower slip ring before the upper slip ring under the axial load.

14. A device in accordance with claim 12, wherein the upper slip ring continues to move axially along the central mandrel under the axial load after the slip segments from the lower slip ring secure the down hole flow control device in the well bore.

15. A device in accordance with claim 12, further comprising:

a plurality of stress inducers disposed about the upper and lower cones, each stress inducer corresponding to a respective fracture region in the upper and lower slip rings, and sized and shaped to transfer an applied load from the upper and lower cone to the fracture regions of the upper and lower slip rings to reduce uneven fracturing of the slip rings into slip segments wherein said upper and lower cone are sized and shaped to induce stress into the upper and lower slip rings, respectively, to cause the slip rings to fracture into slip segments when the axial load is applied to the slip rings.

16. A device in accordance with claim 12, further comprising:

a) an anvil coupled to the central mandrel adjacent the lower slip ring, the anvil having a tapered slip ring engagement surface to engage a corresponding tapered surface of the lower slip ring;

b) a top stop movably disposed on the central mandrel adjacent the upper slip ring, and having a tapered slip ring engagement surface to engage a corresponding tapered surface of the upper slip ring; and c) the corresponding tapered surfaces being sized and shaped to translate forces from the axial load to radial forces on the slip segments to wedge and secure the slip segments against the well bore.

17. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the slip rings, the fracture regions being configured to facilitate longitudinal fractures to break the slip rings into the plurality of slip segments, and each of the plurality of slip segments being configured to secure the down hole flow control device in the well bore;

c) an upper backing ring and a lower backing ring disposed on the central mandrel between the packer ring and the upper and lower slip rings, respectively, each of the upper and lower backing rings further including:

i) a plurality of backing segments disposed circumferentially around the central mandrel; and ii) a plurality of fracture regions disposed between respective backing segments, the fracture regions being configured to fracture the upper and lower backing rings into the plurality of backing segments when an axial load induces stress in the fracture regions, and the backing segments being sized and shaped to reduce longitudinal extrusion of the packer ring when the packer ring is compressed to form the seal between the central mandrel and the well bore;

d) a tapered cut out extending circumferentially around an inner surface of the top stop;

e) a tapered cut out extending circumferentially around an outer surface of the central mandrel;

f) a tapered wedge ring disposed around the central mandrel and inside the tapered cut out of the top stop when the top stop is disposed on the central mandrel; and g) the wedge ring being movable with the top stop so as to engage the tapered cut out of the central mandrel as the top stop moves downward axially along the central mandrel such that the wedge ring wedges between the tapered cut out of the top stop and the tapered cut out of the central mandrel to secure the top stop on the central mandrel and limit axial movement of the down hole tool.

* * * * *